US006198056B1

(12) United States Patent
Wisinski

(10) Patent No.: US 6,198,056 B1
(45) Date of Patent: Mar. 6, 2001

(54) ELECTRICAL CIRCUIT DISRUPTER

(75) Inventor: Jeffrey David Wisinski, Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/415,713

(22) Filed: Oct. 12, 1999

(51) Int. Cl.[7] ..... H01H 3/00
(52) U.S. Cl. ..... 200/17 R; 200/61.08
(58) Field of Search ..... 200/17 R, 43.04, 200/43.16, 43.19, 43.21, 52 R, 61.08, 61.19, 300, 329, 334, 61.18

(56) References Cited

U.S. PATENT DOCUMENTS 2,928,912 * 3/1960 Molnar, Jr. ..... 200/61.19
3,260,831 * 7/1966 Fasal et al. ..... 200/168
3,832,501 * 8/1974 Amnotte ..... 200/61.19
4,636,603 * 1/1987 Pliml ..... 200/296
5,124,685 * 6/1992 Rankin ..... 340/568
5,272,292 * 12/1993 Aubert ..... 200/61.08
5,578,996 * 11/1996 Watson et al. ..... 340/628

* cited by examiner

*Primary Examiner*—Michael Friedhofer
(74) *Attorney, Agent, or Firm*—Ann Agosti; Carl A. Rowold

(57) ABSTRACT

A circuit disrupter having a first conductor and a second conductor partially disposed in an enclosure. A connector is biased to an open position by a spring, but is held in an engaged position by a tab to connect first conductor to second conductor. When an operator removes tab, connector moves to the open position, thereby disconnecting first circuit element from second circuit element. Because the operator does not have access to the interior of enclosure, the first and second circuit elements will remain disconnected until appropriate maintenance activity is undertaken. The absence of tab from the circuit disrupter is a signal that such maintenance activity is required.

13 Claims, 1 Drawing Sheet

ELECTRICAL CIRCUIT DISRUPTER

BACKGROUND OF THE INVENTION

This invention relates generally to the field of electrical circuitry, and more particularly to a switching device in an electrical circuit, and especially to a non-reversible circuit disrupter for an electrical circuit.

It is known in the art to provide electrical circuits having a variety of connecting and switching devices. Two elements of an electrical circuit may be connected by a permanent connection, such as by a jumper wire, or they may be connected by an interruptible connection, such as an electrical switch. The selection of the appropriate type of connection or switching mechanism for a particular circuit is driven by the functionality required of that circuit.

The assignee of the present invention has commercialized an Intelligent Fuel Saver™ system for locomotive engines in order to reduce the amount of fuel used by the locomotive when it is parked with the diesel engine running at idle speed. The Intelligent Fuel Saver system is operable to stop and to re-start the diesel engine at periodic intervals depending upon the ambient temperature. Because of significant fuel savings that can be achieved by operating the Intelligent Fuel Saver system, the owner of a locomotive employing the system may prefer to have the system constantly energized and operable while the locomotive is in service. However, because the Intelligent Fuel Saver system is capable of starting the diesel engine without operator intervention, safety considerations mandate that the operator of the locomotive have the ability to disconnect the Intelligent Fuel Saver system at his or her discretion. Currently, the Intelligent Fuel Saver system is hard-wired into the locomotive control circuitry. In the event that the operator desires to disable the Intelligent Fuel Saver circuitry, it is necessary for the operator to disconnect a jumper wire from a terminal strip located on the locomotive. This operation can be time consuming and may require specific tooling. Furthermore, the operator is free to reverse the process by reconnecting the jumper wire, thereby reconnecting the Intelligent Fuel Saver system. In the event that the system is disconnected and then reconnected, there is no record of such actions and there is no notice provided to maintenance personnel of a need to investigate the cause for the original disconnection of the system.

It is possible to utilize a standard switch device for connecting and disconnecting the Intelligent Fuel Saver system. A switch would simplify the disconnecting operation for the operator and would eliminate any need for special tooling. However, a switch would also allow the operator to arbitrarily connect and disconnect the system without providing any notification to maintenance personnel. The owner of the locomotive may prefer that the Intelligent Fuel Saver system be disconnected only when necessary for maintenance reasons, and further, that maintenance personnel be notified promptly when such maintenance or repair is necessary.

BRIEF SUMMARY OF THE INVENTION

Thus there is a particular need for a connector for the Intelligent Fuel Saver system that allows the system to be disconnected by the locomotive operator in a simple and time effective manner, but that also prevents the operator from reconnecting the system without appropriate notification to maintenance personnel. This need is satisfied in a electrical circuit disrupter comprising a means for connecting and disconnecting a first circuit element and a second circuit element; a means for switching the means for connecting and disconnecting from a connected mode, wherein the first circuit element is connected to the second circuit element, to a disconnected mode, wherein the first circuit element is disconnected from the second circuit element; and a means for preventing the means for connecting and disconnecting from being switched to the connected mode once it has been switched to the disconnected mode by the means for switching.

DETAILED DESCRIPTION OF THE INVENTION

Figure 1:
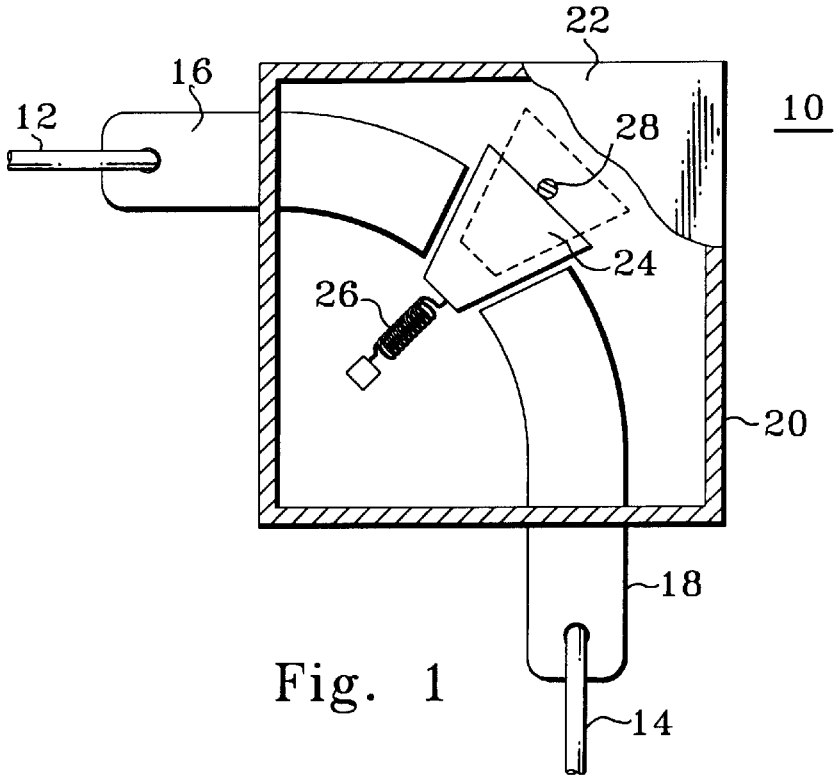
FIG. 1 is a top view of a portion of an electrical circuit having a circuit disrupter, with a portion of the top of the enclosure of the circuit disrupter removed to expose internal components.

FIG. 1 illustrates an electrical circuit disrupter 10 connecting a first circuit element 12 to a second circuit element 14. Circuit elements 12 and 14 are illustrated as wires, but it may be appreciated that the circuit disrupter 10 may be connected to a connector strip, printed circuit board, grounding strip, or other known electrical circuit element. Circuit element 12 is connected to a first conductor 16, and circuit element 14 is connected to a second conductor 18. Conductors 16, 18 may be formed of any electrically conductive material, and may be any shape to fit a particular application. In the embodiment illustrated in FIG. 1, first and second conductors 16, 18 are illustrated as being flat bars having a generally curved shape resulting in an L-shaped configuration for disrupter 10. Conductors 16, 18 each have one end disposed within an enclosure 20. Enclosure 20 is illustrated as having its top portion 22 partially removed so as to reveal the location of components within the enclosure 20. Enclosure 20 may be formed of any material known in the art, and may advantageously be formed of plastic or other durable, non-conductive material.

A connector 24 is disposed within enclosure 20 and is operable to be moved from an engaged position, as illustrated in FIG. 1 with solid lines, to an open position as illustrated in FIG. 1 in phantom. When connector 24 is in the engaged position, it provides an electrical connection between the first conductor 16 and the second conductor 18 by being in physical contact there between. When connector 24 is moved to the open position, the electrical connection between conductors 16, 18 is broken, thereby disconnecting circuit elements 12, 14.

Figure 2:
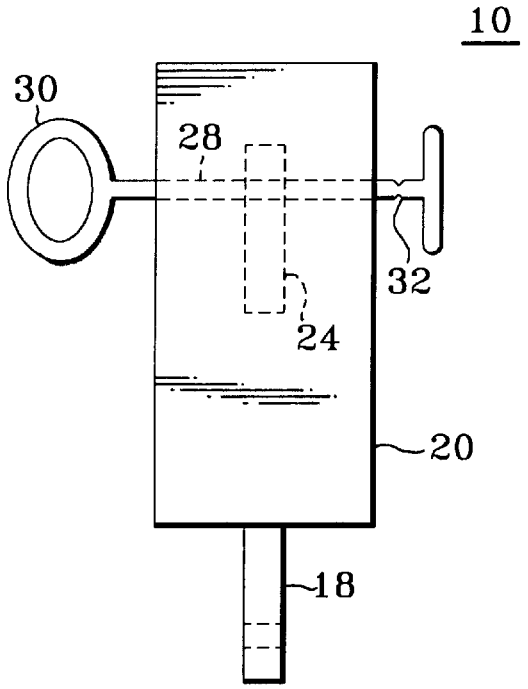
FIG. 2 is a side view of the circuit disrupter of FIG. 1.

A predisposer, shown as a spring 26, is provided to bias connector 24 toward the open position. During the assembly of disrupter 10, spring 26 is compressed to move conductor 24 to the engaged position, and a tab 28 is inserted through enclosure 20 to hold conductor 24 in the engaged position. Tab 28 functions as a release mechanism for holding conductor 24 in the engaged position until removed by an operator, thereby releasing connector 24 to be moved to the open position by the action of spring 26. A non-reversible release mechanism of any design may be utilized in lieu of tab 28. The location and shape of tab 28 can be more clearly appreciated by considering FIG. 2 together with FIG. 1. FIG. 2 is a side elevational view of the disrupter 10 of FIG. 1. Second conductor 18 can be seen extending beyond enclosure 20. No circuit element is illustrated in FIG. 2. Tab 28 has a portion (illustrated in phantom) passing through enclosure 20. Tab 28 also includes a loop 30 or other means for pulling the tab 28 on a portion extending outside the enclosure 20. Tab 28 may include a portion 32 having a reduced cross-sectional area. Portion 32 is advantageously located opposed loop 30 so that when loop 30 is pulled by an operator, portion 32 will fail mechanically and tab 28 will slide out of the enclosure 20. In this manner, connector 24 (also shown in phantom in FIG. 2) will be permitted to be moved from the engaged position to the open position by spring 26. Because it would be difficult to reinsert tab 28 into enclosure 20, and especially difficult to reposition connector 24 from the open position to the engaged position without having access to the interior of enclosure 20, the design illustrated in FIGS. 1 and 2 functions to prevent the disrupter 10 from being switched from the open position to the engaged position once the connection between circuit elements 12,14 has been broken. To further limit the possibility of re-connecting circuit elements 12,14 once tab 28 has been removed, enclosure 20 may be sealed against access by the operator, such as by gluing top 22 onto a cast or molded enclosure 20.

Tab 28 may be formed of plastic, or other material conveniently breakable by a simple pulling motion, and may be formed of a brightly colored material to make its presence or absence immediately noticeable to the maintenance personnel performing an inspection of the circuitry. If tab 28 is missing from circuit disrupter 10, maintenance personnel will be alerted to inquire about the reason that the associated circuitry was taken out of service. Not only is the circuit disrupter 10 useful in the application of the assignee's Intelligent Fuel Saver system, but it may also be useful in applications where a portion of circuitry is necessary during a first interval, such as during factory testing, but is then undesirable during a second interval, such as during field application. Circuit disrupter 10 provides a means for connecting two circuit elements 12,14 in a connected mode, then easily switching to a disconnected mode by disconnecting the circuit elements 12, 14, while also providing a means for preventing the disrupter 10 from being switched back to the connected mode.

While the invention has been described with reference to a preferred embodiment, it will be understood by those skilled in the art that various changes may be made and equivalence may be substituted for elements thereof without departing from the scope of the invention. In addition, many modifications may be made to adapt a particular situation or material to the teachings of the invention without departing from the essential scope thereof. For example, a non-reversible release mechanism of any design may be utilized in lieu of tab 28. For example, a pin or a lever and ratchet mechanism may be envisioned to permit the operator to move the connector 24 from the engaged position to the open position, while preventing the operator from returning the conductor 24 from the open position to the engaged position. Further, the function of spring 26 may be performed by a natural elasticity incorporated into the design of connector 24, wherein when connector 24 is bent to the engaged position, it has an internal biasing force tending to move it toward the open position. Connector 24 may be formed of any conducting material, including both solids and conducting liquids. In one embodiment it may be envisioned that a liquid connector 24 is permitted to drain away from conductors 16, 18 by a valve mechanism positioned by the operator. A check valve design may be used to prevent the liquid conductor from returning to the engaged position once it has been moved to the open position. Furthermore, conductors 16, 18 may themselves be displaced from a connected to a disconnected position in an embodiment wherein no separate connector 24 is utilized. Other hardware embodiments of the disrupter 10 may include micro-circuitry, and software embodiments performing one or more of the functions of the disrupter 10 may be envisioned for advanced control systems or applications where operator access is limited. Therefore, it is intended that the invention not be limited to the particular embodiment disclosed as the best mode contemplated for carrying out this invention, but that the invention will include all embodiments falling within the scope of the appended claims.

What is claimed is:

1. An electrical circuit disrupter comprising:

means for connecting and disconnecting a first circuit element and a second circuit element, said means comprising a first conductor connected to the first circuit element;

a second conductor connected to the second circuit element;

a connector operable to be moved from a first position connecting the first conductor to a second conductor to a second position disconnecting the first conductor from the second conductor;

means for switching the means for connecting and disconnecting from a connected mode, wherein the first circuit element is connected to the second circuit element, to a disconnected mode, wherein the first circuit element is disconnected from the second circuit element;

means for preventing the means for connecting and disconnecting from being switched to the connected mode once it has been switched to the disconnected mode by the means for switching; and means for biasing the connector toward the second position.

2. The electrical circuit disrupter of claim 1, wherein the means for biasing comprises a spring.

3. The electrical circuit disrupter of claim 1, wherein the means for switching comprises a tab operatively associated with the connector to hold the connector in the first position.

4. The electrical circuit disrupter of claim 3, wherein the means for switching further comprises a means for pulling the tab away from the connector to permit the means for biasing to move the connector to the second position.

5. The electrical circuit disrupter of claim 4, wherein the means for preventing comprises an enclosure containing the connector, and wherein the tab has a first portion proximate the connector within the enclosure and a second portion extending outside the enclosure.

6. The electrical circuit disrupter of claim 5, wherein the second portion of the tab comprises a loop.

7. The electrical circuit disrupter of claim 5, wherein the enclosure is sealed against access by an operator.

8. An electrical circuit disrupter comprising:

an enclosure;

a first conductor having a first end disposed outside the enclosure and a second end disposed within the enclosure;

a second conductor having a first end disposed outside the enclosure and a second end disposed within the enclosure;

a connector disposed within the enclosure and operable to be moved from an engaged position connecting the second end of the first conductor and the second end of the second conductor to an open position disconnecting the second end of the first conductor and the second end of the second conductor;

a predisposer for biasing the connector toward the engaged position;

a release mechanism having a first portion disposed within the enclosure and operable to hold the conductor in the open position and a second portion disposed outside the enclosure.

9. The electrical circuit disrupter of claim 8, wherein the release mechanism comprises a tab sized to break when pulled upon by an operator, thereby allowing the connector to move from the engaged position to the open position.

10. The electrical circuit disrupter of claim 8, wherein the predisposer comprises a spring.

11. An electrical circuit comprising:

a first circuit element a second circuit element;

a circuit disrupter connecting the first circuit element and the second circuit element, the circuit disrupter further comprising:

an enclosure;

a first conductor connected to the first circuit element at a first end and having a second end disposed within the enclosure;

a second conductor connected to the second circuit element at a first end and having a second end disposed within the enclosure;

a connector disposed within the enclosure and operable to be moved from an engaged position connecting the second end of the first conductor and the second end of the second conductor to an open position disconnecting the second end of the first conductor and the second end of the second conductor;

a predisposer for biasing the conductor toward the open position;

a non-reversible release mechanism operatively associated with the conductor to hold the conductor in the engaged position until released by an operator but not operable to move the conductor from the open position to the engaged position.

12. The electrical circuit of claim 11, wherein the release mechanism comprises a tab having a first portion disposed proximate the connector and a second portion extending outside the enclosure.

13. The electrical circuit of claim 11, wherein the enclosure is sealed against access by an operator.

* * * * *